United States Patent [19]

Canalizo

[11] Patent Number: 4,551,075

[45] Date of Patent: Nov. 5, 1985

[54] WELL PUMP

[76] Inventor: Carlos R. Canalizo, 10511 Allegheny Dr., Dallas, Tex. 75229

[21] Appl. No.: 487,005

[22] Filed: Apr. 21, 1983

Related U.S. Application Data

[63] Continuation-in-part of Ser. No. 317,449, Nov. 2, 1981, abandoned.

[51] Int. Cl.[4] ..... F04B 47/08

[52] U.S. Cl. ..... 417/383

[58] Field of Search ..... 417/383, 401, 385, 386, 417/387, 388

[56] References Cited

U.S. PATENT DOCUMENTS

| | | | |
|---|---|---|---|
| 1,568,447 | 1/1926 | Forsyth | 417/383 X |
| 2,014,613 | 9/1935 | Ceverha | 417/383 |
| 3,015,280 | 1/1962 | King | 417/401 |
| 3,123,007 | 3/1964 | Orr | 417/401 X |
| 3,963,377 | 5/1974 | Elliott et al. | 417/91 X |
| 4,405,291 | 9/1983 | Canalizo | 417/91 X |

FOREIGN PATENT DOCUMENTS

| | | | |
|---|---|---|---|
| 592448 | 8/1925 | France | 417/383 |

*Primary Examiner*—Leonard E. Smith

[57] ABSTRACT

A well pumping system in which a production piston having a traveling valve therein is arranged in a production cylinder with a standing valve in its inlet and is reciprocated by a power piston attached to the production piston in which power for reciprocating the production system is provided by hydraulic fluid acting on the rod end of the power piston to move the piston in one direction and when the force on the power piston fluid is removed, the hydrostatic head of pressure acting on the head end of the power piston moves the pair of pistons in the opposite direction either by the power fluid having lesser weight than the production fluid or by isolating the hydrostatic head of fluid in the tubing from the production cylinder so that the production cylinder is subjected to bottom hole pressure which will be less than tubing pressure at the pump resulting in return movement of the pistons. There is also disclosed a landing nipple for receiving the pump with by-passes and ports to connect the pump either to tubing and casing annulus or to a pair of tubing suspended in the annulus. In the illustrated embodiment, the forces are such that the pump will always be urged downwardly and the landing nipple supports the pump through a no-go shoulder.

5 Claims, 10 Drawing Figures

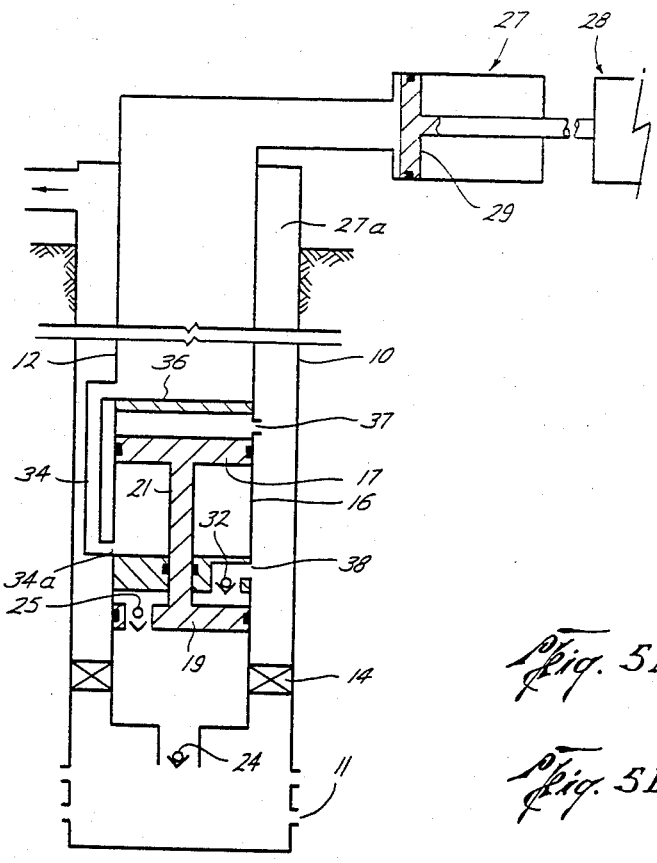
Fig. 3
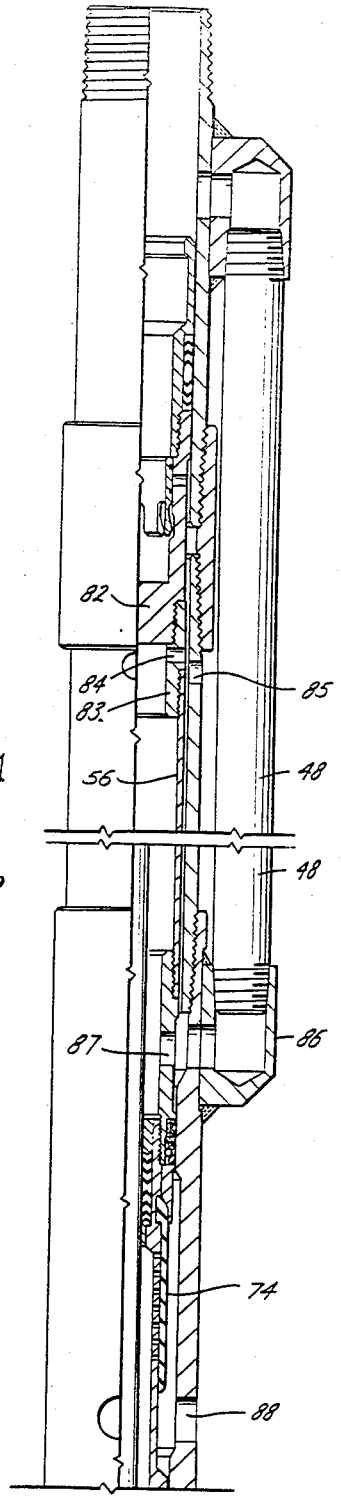
Fig. 5A
Fig. 5B

WELL PUMP

This application is a continuation-in-part of my copending application Ser. No. 06/317,449, filed Nov. 2, 1981, now abandoned.

This invention relates to pumps and more particularly to hydraulic pumps for producing wells.

Hydraulic pumps have been in general use for many years to produce oil. Where the pump is fixed in the well near the producing formation, it has conventionally utilized switching valves to switch the power fluid to opposite sides of the power piston to reciprocate the production piston. This type of pump has the obvious disadvantage of complex valving mechanism which generally is expensive and is subject to wear reducing the time in which the pump may be left in the well.

Recently, pumps have been used which have eliminated the switching valves. In one of these pumps offered by Kobe, Inc. of Houston, Texas, power fluid raises a power piston which in turn raises a weight fluid in the casing thereabove. When the force on the power fluid is removed, the weight fluid returns the power piston to its lower position.

In another recently available form, Baker Packers of Houston, Texas offers a pump in which a power fluid raises a power piston and in so doing, the piston stores energy in a resilient means to return the power piston. The particular resilient means utilized by Baker is a gas charge.

While these pumps have eliminated the need for switching valves they are subject to several disadvantages. As the lifting power is provided either by a resilient means or by weight fluid, the lifting power is generally fixed and it is difficult to change the amount of power applied to the pump to accommodate changing well conditions. In the Baker type of pump employing a gas charge, leakage past the seals on the power piston will result in loss of lifting power.

In both the Baker and Kobe pumps, the power fluid and the production fluid are the same fluid. Thus, the power fluid cannot be used as a dilutant and where the production fluid is highly viscous, more pumping power is required to operate the pump.

Where production fluid is used as a power fluid, it must be treated before it passes through the surface pumping system to remove sand, paraffin and water, etc. which would damage the surface pumping system.

It is an object of this invention to provide a downhole hydraulic pump which does not employ switching valves in which the well fluid is lifted by application of power fluid to a power piston and in which when the force of the surface pumping equipment is removed from the power fluid, the several areas and fluids to which they are exposed result in a force being exerted on the power piston to move it in the opposite direction.

Another object is to provide a hydraulic pump as in the preceding object in which an area of the pumping and production pistons is subjected to the differential between the force exerted by the hydrostatic head of fluid being produced and the bottom hole pressure of the well to move the power and production pistons in one direction.

Another object is to provide a hydraulic pump as in the preceding object in which an area of the pumping and production pistons is subjected to the differential between the force exerted by the hydrostatic head of fluid being produced and the bottom hole pressure of the well to move the power and production pistons in one direction and after the production piston moves downwardly until pressure thereacross is equalized the weight of the movable system continues to exert a downward force.

Another object is to provide a hydraulic pump of the type which does not utilize switching valves in which a pumping fluid is utilized which is of less weight than the production fluid and the power piston is moved in one direction by the force of the power fluid and in the other directin by the differential in weight of the production and power fluid exerted through the hydrostatic head of fluid above the pump.

Another object is to provide a hydraulic pump of the type which does not employ switching valves in which the power fluid and the production fluids are separate and the power fluid may be utilized as a dilutant for the production fluids.

Another object is to provide a well pump of the type which does not employ switching valves in which light oil may be used as power fluid to reduce horsepower requirements for the system as compared to a system employing more viscous production fluids as the power fluids.

Another object is to provide a hydraulic pump of the type which does not require switching valves in which leakage past seals will not affect the pump as make-up fluid may be added to the power fluid at the surface.

Another object is to provide a hydraulic pump of the type which does not utilize switching valves in which the force applied to the power fluid may be varied to accommodate varying well conditions.

Another object is to provide a hydraulic pump which may be landed in a tubing having no by-pass provisions and a power fluid line in the tubing connected between the pump and surface in which the power piston is reciprocated by power fluid.

Other objects, features and advantages of the invention will be apparent from the drawings, the specification and the claims.

In the drawings, wherein illustrative embodiments of this invention are shown and wherein like reference numerals indicate like parts:

FIG. 3 is a schematic view similar to FIG. 1 except that the system has been modified to introduce power fluid through the tubing and to produce through the casing;

FIGS. 5A and 5B are fragmentary quarter-section views with the by-pass pipe in elevation illustrating the modification of the structure shown in FIGS. 4A, 4B, 4C and 4D to convert the landing nipple and pump to production through the casing.

Figure 1:
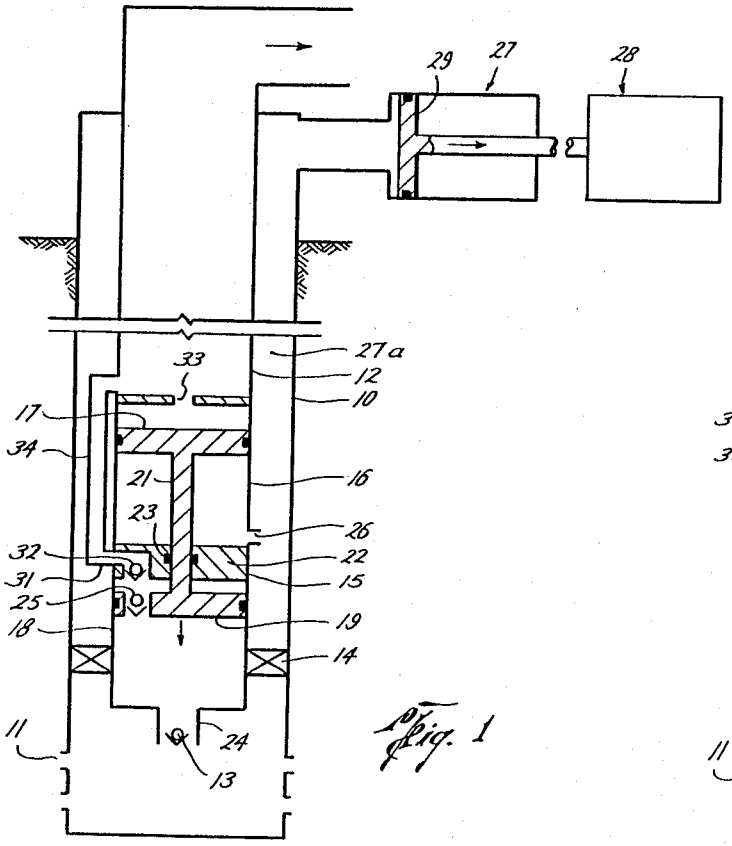
FIG. 1 is a schematic illustration of this invention producing fluid through the tubing and showing the surface pump and the power piston of the pump during the pressure release stroke.
Figure 4A:
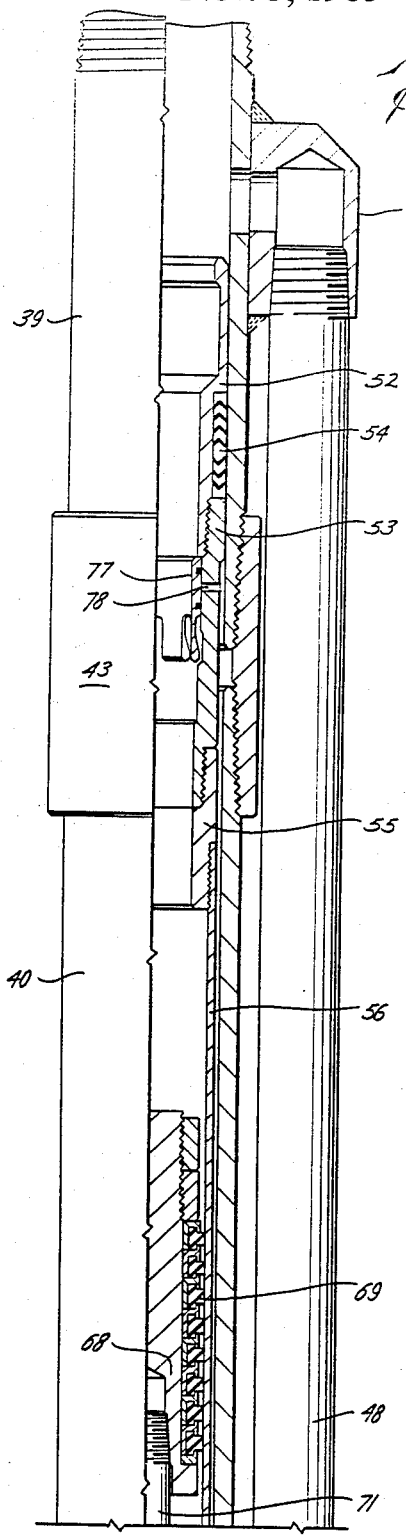
FIG. 4A, 4B, 4C and 4D are continuation views in quarter-section with a by-pass pipe in elevation illustrating the landing nipple and pump of this invention arranged for production through the tubing.
Figure 4B:
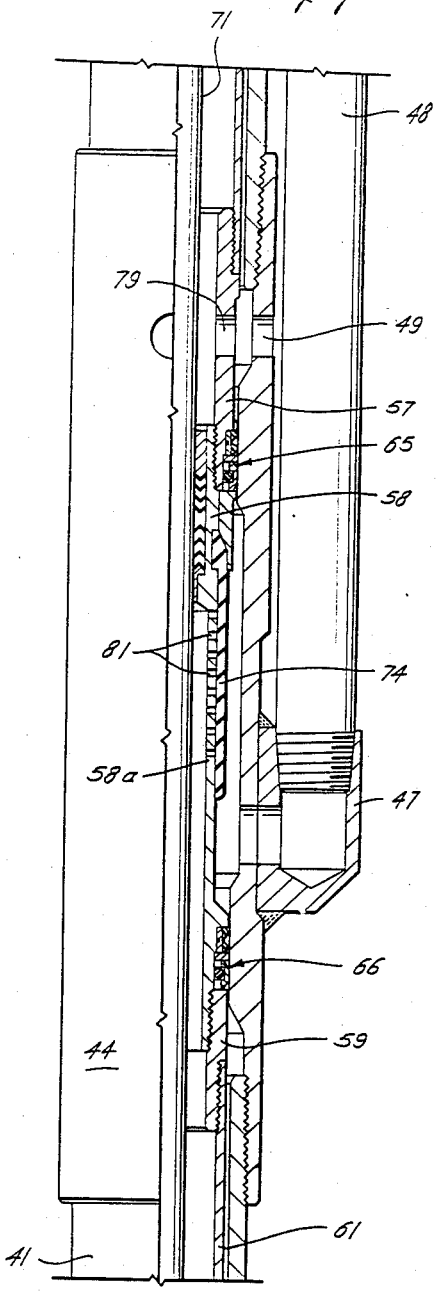
Figure 4C:
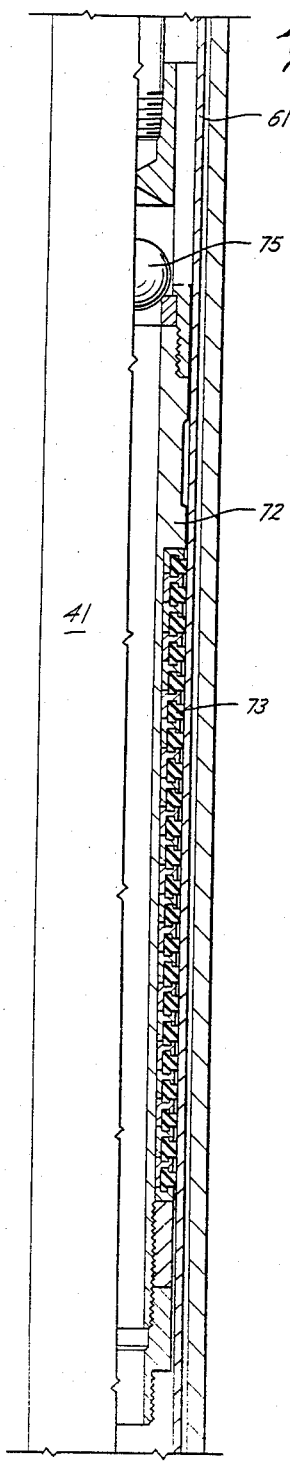
Figure 4D:
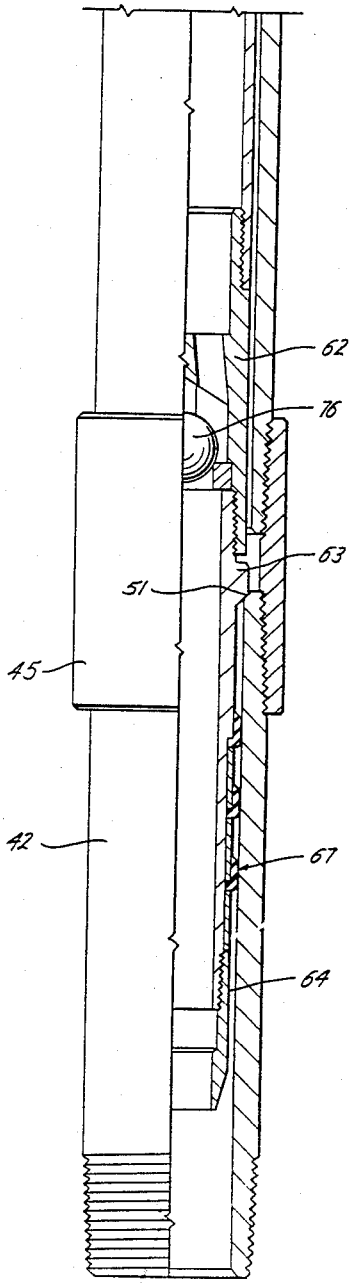

Referring first to FIG. 1, the pump is illustrated for production through the tubing.

Casing 10 has perforations 11 therein at the producing formation. Tubing 12 has at its lower end a standing valve 13 for admitting fluid into the pump. A packer 14 packs off the casing tubing annulus above the producing formation 11.

The pump includes a body 15 which may be any desired form and may be a continuation of the tubing as illustrated in FIG. 1 or may be landed in a landing nipple as shown in FIGS. 4 and 5.

Within the body 15, there is a power section including relatively movable power barrel and power piston. The illustrated form includes a power barrel or cylinder 16 having a power piston 17 reciprocal therein. Also within the body is a pump section including a relatively movable pump barrel and pump piston. The illustrated form includes a production barrel or cylinder 18 having a production piston 19 therein.

The two sections are connected together so that relative reciprocation of the power barrel and power piston results in relative reciprocation of the pump barrel and pump piston. In the illustrated form the two pistons 17 and 19 are rigidly interconnected to move as a unit by the connecting rod 21. The two cylinders 16 and 18 are separated by a wall 22 through which the connecting rod 21 passes and a suitable seal 23 seals with the cnnecting rod.

The production cylinder 18 has at its head end an inlet 24 in which the standing valve 13 is positioned to permit fluid from the formation 11 to pass through the inlet 24 and standing valve 13 into the production cylinder 18.

The head end of the production section is provided with a check valve controlled outlet. Preferably, the production piston 19 is provided with a traveling valve 25 which controls flow of fluid through the piston 19. The traveling valve operates in the usual manner to permit flow past the piston with downward movement of the production piston 19 and to prevent flow with upward movement of piston 19.

A power fluid inlet is provided in the power section. Preferably, inlet 26 is provided in the rod end of the power cylinder 16. This inlet communicates with the tubing casing annulus 27*a* and permits flow of fluid to and from the rod end of the cylinder 16.

In order to control the application of power fluid through the inlet 26 a pump, indicated generally at 27, at the surface is reciprocated by prime mover, indicated generally at 28, in any desired manner. For instance, a crank arm might be provided on a motor which would reciprocate the piston 29 of the pump at a rate controllable by an operator. With this system, power fluid in annulus 27 would be introduced through port 26 into the rod end of cylinder 16 to drive the piston 17 upwardly to its uppermost postion. Then, as the pump piston 29 moves in the direction of the arrow, that is towards the prime mover, the pressure would be removed from the casing annulus and the power fluid within the rod end of the power cylinder 16 would be subject only to the force of the hydrostatic head of fluid within the annulus 27*a*.

A production fluid outlet 31 is provided in the rod end of the production cylinder. In accordance with the preferred form of this invention, the outlet is also provided with a standing valve 32 which will isolate the production cylinder from tubing pressure as the production cylinder 29 moves downwardly.

The head end of the power cylinder is connected to the tubing through a passageway 33. As shown, the by-pass 34 interconnects the outlet 31 with the tubing.

Figure 2:
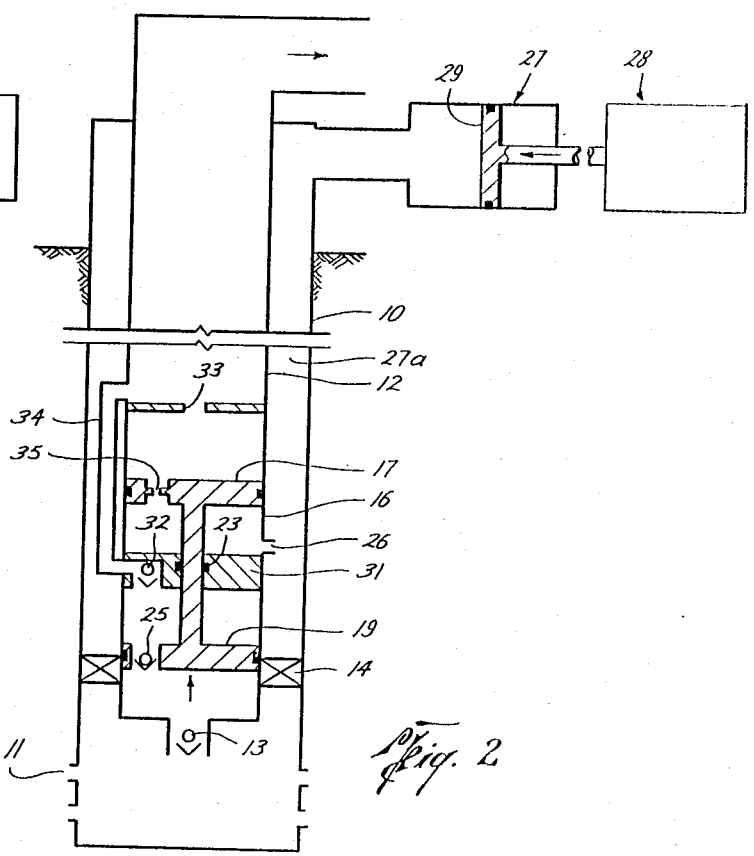
FIG. 2 is a schematic view similar to FIG. 1 illustrating the piston assembly of FIG. 1 during the power stroke and additionally illustrating a metering orifice injecting a portion of the power fluid into the production fluid as a dilutant.

The operation of the pump is illustrated in FIGS. 1 and 2. In FIG. 2, the pump piston 29 is pressurizing the casing annulus and driving the power fluid through the inlet 26 into the rod end of cylinder 16 to be effective on the pressure responsive member provided by the downwardly facing surface of the power piston 17 to lift the power and production pistons upwardly as indicated by the arrow. As the piston rises, it is opposed by the force exerted by the hydrostatic head of fluid in the tubing on the head end of the power piston 17 as well as the rod end of the production piston 19. Formation fluid is effective on the head end of the production piston to urge the piston upwardly and sufficient force is provided by the pump 27 when assisted by the formation pressure on the production piston to drive the power and production pistons upwardly to lift well fluids within the tubing to the surface. As the surface pump 27 finishes its power stroke and retracts, as shown in FIG. 1, the pressure exerted by the pump on the casing tubing annulus 27 is removed and this force is no longer effective on the rod end of the power piston 17.

The standing valve 32 may be omitted, if desired. The formation pressure will be much less than the pressure exerted by the hydrostatic head in the production tubing. Thus, as the production piston reaches the top of its stroke, it will be subjected on its upper surface to production tubing pressure and on its lower surface to the much less formation pressure. With the check valve 32 removed, this differential in pressure will exert a downward force which will urge the two pistons and their connecting rods downwardly when the power fluid pressure is reduced. This will begin the downward movement of the two pistons and connecting rod. As the production piston moves downwardly, it will compress the fluid in the suction chamber below the production piston until it reaches the value of production conduit pressure at which time the check valve 25 will open as pressure across the production piston is equalized. At this time the weight of the two pistons and connecting rod which have been exerting a downward force urging the pistons and rod downwardly will continue to be effective and carry the pistons and connecting rod to their full down position.

Also, where a light oil is used as power fluid, the standing valve 32 in the outlet from the production cylinder 18 may be omitted if desired. In this case, tubing pressure will be equalized across the production piston as it moves downwardly and pressure fluid within the head end of production cylinder 18 moves through the traveling valve 25. Thus, there will be a net upward force of tubing pressure on the area of the connecting rod 21. This force is equalized by the tubing pressure acting downwardly on the head end of piston 17 over the same area. As the head end of piston 17 over the remaining area is subjected to the differential between tubing pressure and the light oil power fluid, there is a net downward force exerted due to the difference in weight of the tubing and power fluid resulting in downward movement of the pistons 17 and 19. Thus, the force exerted due to use of a light oil will be exerted in addition to the forces above discussed to move the two pistons and connecting rods to their down position.

In one preferred form, the standing valve 32 in the outlet from the rod end of the production cylinder is utilized to isolate the production piston 19 from tubing pressure during its downward movement. In this case, in addition to the forces discussed above, the production piston 19 will be subjected to formation or bottom hole pressure on both sides after the piston 19 has been moved down to open travelling valve 25 and will have a resultant upward force exerted by bottom hole pressure on the area of the connecting rod 21. As this bottom hole pressure is always much less than tubing pressure, the force of tubing pressure acting over the area of the connecting rod 21 on the head end of power piston 17 drives the power piston downwardly. In this manner, the production piston 19 is reciprocated in response to reciprocation of the pump 29 to lift formation fluid through the tubing to the surface.

Referring again to FIG. 2, a bleed 35 may be provided in any desired area, such as through the power piston 17, to gradually bleed a portion of the power fluid into the production fluid to act as a dilutant. Another convenient place for a bleed would be through the packer 14 if it is desired to dilute the production fluid prior to it reaching the pump.

Referring to FIG. 3, the pump is shown arranged for production through the casing tubing annulus 27*a*. The pump is the same construction as FIG. 1 except that the passageways and ports are different. The by-pass 34 now opens into the rod end of the power cylinder 16 at the inlet 34*a*. The top of the pump is closed to the tubing by member 36 and a port 37 communicates the head end of cylinder 16 with the casing tubing annulus 27. The outlet from the rod end of the production cylinder now communicates with the casing tubing annulus 27 through the port 38. The construction and operation of the pump is the same, the only difference being the connection to the tubing and casing annulus to provide for production through the casing. This is desirable in the case of pumping highly viscous fluids as the larger casing tubing annulus will reduce the frictional resistance to flow.

Referring now to FIGS. 4A, 4B, 4C and 4D, the pump is shown to be of the wireline design and to be supported within a landing nipple especially designed for the pump. The type of pump shown is one which produces through the tubing.

The landing nipple is made up of sections of tubing 39, 40, 41 and 42 coupled together by couplings 43, 44 and 45.

A ported lug 46 is provided on the upper section of tubing 39 and a ported lug 47 is provided on the collar 44. Intermediate these two ported lugs is a by-pass pipe 48 which serves the function of the by-pass pipe 34 of FIG. 1. The upper end of tubing 39 is adapted to be secured to a string of tubing and is open below lug 46, provides access for tubing fluid to the power piston in the same manner taught in FIG. 1.

To permit entry of power fluid into the pump, the landing nipple is provided with an inlet port 49 in coupling 44 which corresponds to port 26 of FIG. 1 to direct power fluid to the pump.

At all times, the pump is exposed to a downward force due to the relative areas and pressures of fluid exerted against the pump. Therefore all that is needed to support the pump is a no-go shoulder in the landing nipple and for this purpose, the nipple is provided at 51 on the upper end of the lowermost section of pipe 42 with a no-go shoulder to support the pump within the landing nipple.

Referring now to the pump specifically, it includes a body of several members threaded together. Beginning at the top of the pump, the body includes the fishing neck section 52 which is threaded into a by-pass collar 53 and meaintains in position the seal 54 which seals between the pump and tubing 39. Below the by-pass sub 53 an adapter 55 is provided which is threaded to the power cylinder 56. Below the power cylinder 56 is an adapter sub 57 which is secured to the back check valve housing 58. Below the back check valve housing 58 is an adapter 59 from which depends the production cylinder 61. The lower end of the production cylinder is secured to the standing valve housing 62 which in turn is secured to the no-go sub 63. A seal retainer 64 at the lower end of the pump completes the housing.

Considering next the seal means between the housing and the landing nipple, the upper seal 54 has been previously referred to . Below the power fluid inlet 49, seal 65 is provided to seal between the pump and the landing nipple. The seal 66 seals between the nipple and pump immediately below the lug 47. At the lower end of the pump, seal 67 seals between the landing nipple and pump housing.

Within the power cylinder 56, there is power piston 68 having a suitable seal 69 thereon for sealing with the wall of the cylinder. The power piston is mounted on the connecting rod 71 which in turn is connected to the production piston 72 slidable within the production cylinder 61 and sealing therewith through a suitable seal 73.

A back check valve provided by a rubber sleeve 74 surrounding a ported section 58*a* of member 58, acts as a standing valve corresponding to standing valve 32 of FIG. 1 at the outlet of the production cylinder to protect the production piston from the hydrostatic head of fluid in the tubing during downward movement of the production piston.

The production piston 72 carries traveling valve 75 which corresponds to the traveling valve 25 in the production piston of FIG. 1.

Secured in the housing at its lower end in the area of the collar 45 is the standing valve 76 which corresponds to standing valve 13 in FIG. 1 controlling the entrance to the production cylinder.

Within the uppermost collar 43, there is provided a by-pass sleeve 77 which cooperates with a port 78 in collar 43 to control flow of fluid through this port. In pulling the pump, the polish bore of the upper tubular section 39 is of short dimension above the packing 54 and difficulties should not be encountered in pulling the pump. However, if difficulty is anticipated, the running tool may be designed to move the sleeve 77 downwardly to open port 78 and provide a by-pass to avoid a pressure lock at the seal 54. The other seals move immediately into larger diameter areas and it is not expected that any problem will result of the nature of pressure block interfering with pulling of the pump due to the other seals.

To support the pump within the landing nipple, the lower collar 45 has enlargement 63 providing a downwardly facing no-go shoulder for engagement with shoulder 51 on lower tubing 42.

The pump shown in FIG. 4 operates in the manner previously explained with regard to FIG. 1. The power piston is shown in approximately its uppermost position and as the pressure is removed from the fluid within the casing tubing annulus, the pistons 68 and 72 move downwardly. As a check valve is employed at the outlet of the production cylinder, the pistons are initially urged downwardly by the pressure differential across the production piston and the weight of the pistons and rod. As pressure equalizes across the production piston, the area of the connecting rod 71 has effective on its upper end the force exerted by the hydrostatic head of fluid within the tubing being opposed from below by the same area exposed to bottom hole pressure which is much less than tubing pressure. If the pump fluid used is of a lighter weight than the production fluid, an additional force would be generated across the power piston moving the piston to its lowermost position to fill the area in the production cylinder above the production piston with fluid to be pumped and to move the power piston to its lowermost position. Thereafter, pressurizing of the casing tubing annulus will exert a force through the inlet 49 and port 79 leading into the rod side of the power cylinder 56 to exert an upward force driving the power piston upwardly. As the piston drives upwardly, the fluid trapped by the traveling valve 75 within the rod side of the production cylinder will pass through slots 81 and check valve 74 to the lower lug 47. Production will then flow up through the by-pass 48 and upper lug 46 into the upper end of the pump and thence through the tubing to the surface.

Reference is now made to FIGS. 5A, and 5B which show the manner in which the pump is modified to provide for production through the casing as in FIG. 3. The by-pass sub 53 is replaced with a by-pass sub 82 which is closed at its lower end to close the upper end of the power cylinder 56 to tubing fluid. The adapter 55 is replaced with an adapter 83 having a port 84 therein communicating casing annulus fluid to the top of the power piston. The fluid reaches the top of the power piston by port 85 provided in the landing nipple.

Referring to FIG. 5B, the by-pass lug 47 is replaced by a new lower by-pass lug 86 which is at a higher elevation and communicates through port 87 with the rod end of the power piston. Thus power fluid injected down through the tubing passes through the by-pass pipe 48 and lug 86 to port 87 and is effective on the rod side of the power piston.

The landing nipple is provided with a port 88 which communicates with the back check valve provided by sleeve 74 and fluid from the rod end of the production cylinder now passes through the port 88 into the casing tubing annulus for lifting to the surface. The pump as modified in FIGS. 5A and 5B conforms to the pump shown in FIG. 3 for production in the casing tubing annulus. The operation of the pump modified for casing production is the same as explained in conjunction with FIG. 3.

Figure 6:
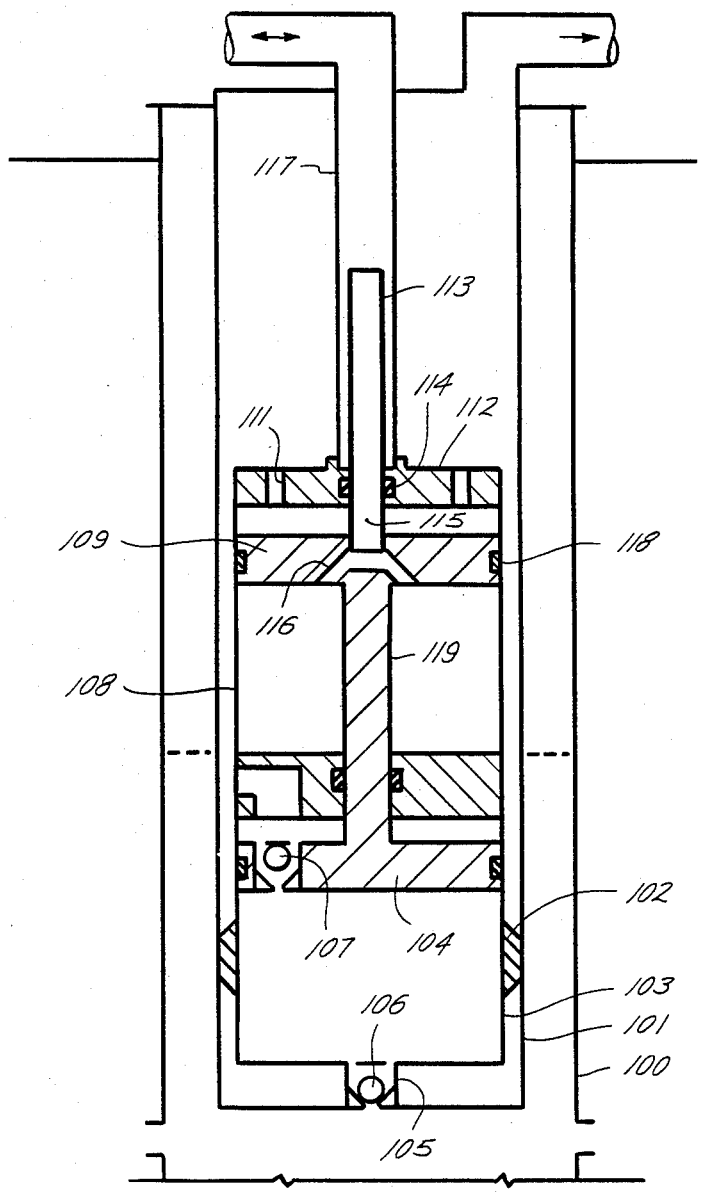
FIG. 6 is a schematic illustration of a still further form of a hydraulic pump.

In FIG. 6 there is shown a form of this invention which may be run into a well having a tubing without provision for by-pass. Thus, in a well utilizing a rod pump the rod and pump may be pulled and the pump of this invention run into the tubing and landed in the seating nipple which had been utilized with the rod-type pump.

The casing 100 has suspended therein a conventional tubing 101 including a conventional seating nipple 102.

The pump includes the production section barrel or cylinder 103 in which there is reciprocal the production piston 104. Formation fluid enters the pump through inlet 105 having a standing valve 106 therein. Production fluid leaves the suction side of the pump through a check valve controlled outlet, such as provided by the travelling valve 107 in the piston 104.

The power section includes the working barrel or cylinder 108 in which the power piston 109 is reciprocal. The upper end of the power barrel has a plurality of openings 111 which communicate the barrel above the power piston 109 with the production tubing 101. Also, the upper end 112 of the power barrel has an opening therethrough and a polish tube 113 which is carried by the power piston 109 extends through the opening and is sealed thereto by a polish tube packing 114. The flowway 115 through the polish tube communicates through ports 116 in the power piston with the working barrel below the power piston 109.

Communication between the polish tube 113 and power fluid supply line 117 is provided in any desired manner. The power fluid supply line 117 may be connected in sealing relationship with the top 112 of the power barrel about the polish tube 113 in any desired manner. The connection may be permanent and the supply line may be run with the pump or the pump may be first run and the supply line 117 thereafter sealingly engaged with the upper end 112 of the working barrel about the polish tube 113, as will be understood by those skilled in the art.

The interconnected pistons are lifted in the manner explained hereinabove by increasing the pressure in the power fluid conduit to drive the power piston upwardly.

When the power fluid pressure is reduced the hydrostatic pressure of power fluid acts over the area of seal 114 to urge the piston down. The hydrostatic pressure of production fluid acts over the area of seal 118 less the area of seal 114. Thus, if production and power fluids have the same weight the forces urging the system downward are the same as above discussed.

If the power and production fluids have the same weight the size of the polish tube 113 is not important. If power fluid is of less weight the size of the polish tube preferably is small to minimize the downward effect of power fluid.

When the production and power fluids have the same weight, there is a differential in pressure of the production fluid and the formation fluid urging the production piston 104 down and this force plus the weight of the two pistons and connecting rod initially urge the movable system downward. Also, the differential in production fluid and formation fluid across the area of the rod 119 urges the production piston 104 downwardly until the pressure on the suction side of the production piston 104 reaches the pressure of the production fluid on the rod side of piston 104 at which time the valve 107 opens. The pistons and connecting rod are continued in their downward movement by the weight of the two pistons, rod 19 and the polish tube 113, even though all force due to pressure of the fluids is now equalized.

While the power piston and the production piston have been shown of equal diameters, it will be appreciated that the production piston could have a smaller diameter to permit the well to produce from a greater depth utilizing power fluid at the same pressures.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A hydraulic pump comprising, a body, a power cylinder in said body, a power piston in said power cylinder, a production cylinder in said body,
a production piston in said production cylinder,
a connecting rod rigidly interconnecting said pistons,
a production fluid inlet to the head end of the production cylinder,
a standing valve in said production fluid inlet,
a traveling valve in said production piston,
a power fluid inlet to the rod end of said power cylinder,
a production fluid outlet in the body connected to the head end of the power cylinder and to the rod end of the production cylinder,
seal means about the exterior of the body, and support means on the body:
in combination with;
a landing nipple having support means for engagement with said pump support means and supporting said pump,
a polish bore section for receiving said seal means, and
a by-pass passageway extending from a point above the pump to a first point to provide fluid communication with the rod end of the production cylinder,
said nipple having a port establishing fluid communication with the rod end of the power cylinder.

2. A hydraulic pump comprising,
a body,
a power cylinder in said body,
a power piston in said power cylinder,
a production cylinder in said body,
a production piston in said production cylinder,
a connectiong rod rigidly interconnecting said pistons,
a production fluid inlet to the head end of the production cylinder,
a standing valve in said production fluid inlet,
a traveling valve in said production piston,
a power fluid inlet to the rod end of said power cylinder,
a production fluid outlet in the body connected to the head end of the power cylinder and to the rod end of the production cylinder,
said power fluid inlet provided by a polish tube carried by the power piston and exposed to the rod side of the power piston and extending through and having a sliding seal with the end of the power cylinder, and
a power fluid connection carried by the power clinder and surrounding said polish tube.

3. A pump system for petroleum wells comprising:
a pump section including:
a pump barrel and pump piston relatively reciprocal to each other,
an inlet in the pump barrel exposing one end of the pump barrel to formation pressure,
a standing valve in said inlet,
an outlet from the other end of the barrel, and
a first check valve in said outlet;
a power section including:
a power barrel and power piston relatively reciprocal to each other, and
one of said power barrel and power piston having a downwardly facing pressure responsive surface;
connecting rod means connecting said pump section and power section together for relative reciprocation of said pump barrel and piston in response to relative reciprocation of said power barrel and piston;
a power fluid conduit extending from one end portion of the power barrel to the surface and conducting power fluid to said pressure responsive surface;
a surface pump alternately increasing and decreasing the pressure in said power fluid conduit; and
a production fluid conduit interconnecting the other end of the power barrel and pump barrel outlet and the other end of the pump barrel and extending to the surface to conduct production fluid from the pump to the surface;
said pressure responsive member being the downwardly facing surface of the power piston;
said power fluid conduit extending from the upper end of the power barrel; and
a polish tube carried by the power piston and having a sliding seal with the upper end of the power barrel and conducting fluid between the downwardly facing pressure responsive surface and the power fluid conduit.

4. A pump system for petroleum wells comprising:
a pump section including:
a pump barrel and pump piston relatively reciprocal to each other,
an inlet in the pump barrel exposing one end of the pump barrel to formation pressure,
a standing valve in said inlet,
an outlet from the other end of the barrel, and
a first check valve in said outlet;
a power section including:
a power barrel and power piston relatively reciprocal to each other,
one of said power barrel and power piston having a downwardly facing pressure responsive surface;
connecting rod means connecting said pump section and power section together for relative reciprocation of said pump barrel and piston in response to relative reciprocation of said power barrel and piston;
a power fluid conduit extending from one end portion of the power barrel to the surface and conducting power fluid to said pressure responsive surface;
a surface pump alternately increasing and decreasing the pressure in said power fluid conduit; and
a production fluid conduit interconnecting the other end of the power barrel and pump barrel outlet and the other end of the pump barrel and extending to the surface to conduct production fluid from the pump to the surface;
said pressure responsive member being the downwardly facing surface of the power piston;
said power fluid conduit extending from the upper end of the power barrel;
a polish tube carried by the power piston and having a sliding seal with the upper end of the power barrel and conducting fluid between the downwardly facing pressure responsive surface and the power fluid conduit; and
means on the exterior of one of the power and pump sections for sealing with a well tubing.

5. A downhole hydraulic pump for lifting fluids in a petroleum well comprising,
a body,
a power cylinder in said body,
a power piston in said power cylinder,
a production cylinder in said body, a production piston in said production cylinder,
a connecting rod rigidly interconnecting said pistons,
a production fluid inlet to the head end of the production cylinder,
a standing valve in said production fluid inlet,
a traveling valve in said production piston,
a power fluid inlet to the rod end of said power cylinder,
a production fluid outlet in the body connected to the head end of the power cylinder and to the rod end of the production cylinder,
seal means about the exterior of the body, and support means on the body:

in combination with;
a landing nipple having support means for engagement with said pump support means and supporting said pump,
a polish bore section for receiving said seal means, and
a by-pass passageway extending from a point above the pump to a point providing fluid communication with the rod end of the power cylinder,
said nipple having ports communicating with the head end of the power cylinder and the rod end of the production cylinder.

* * * * *

UNITED STATES PATENT AND TRADEMARK OFFICE

CERTIFICATE OF CORRECTION

PATENT NO. : 4,551,075

DATED : November 5, 1985

INVENTOR(S) : Carlos R. Canalizo

It is certified that error appears in the above-identified patent and that said Letters Patent is hereby corrected as shown below:

On the title page insert -- [73] Assignee: Otis Engineering Corporation, Carrollton, Tex. -.

Signed and Sealed this

*Thirteenth* Day of *May 1986*

[SEAL]

*Attest:*

DONALD J. QUIGG

*Attesting Officer*

*Commissioner of Patents and Trademarks*